US005575391A

United States Patent [19]

Gerch

[11] Patent Number: 5,575,391

[45] Date of Patent: Nov. 19, 1996

[54] GARMENT CARRIER WITHIN SUITCASE AND METHOD FOR PACKING

[75] Inventor: Edward L. Gerch, Chicago, Ill.

[73] Assignee: Kingport International Corporation, Evanston, Ill.

[21] Appl. No.: 490,094

[22] Filed: Jun. 6, 1995

Related U.S. Application Data

[63] Continuation of Ser. No. 137,610, Oct. 14, 1993, abandoned.

[51] Int. Cl.[6] ..... A45C 5/14; A45C 5/12; A45C 13/26; A45C 13/30

[52] U.S. Cl. ..... 206/527; 206/279; 190/18 A; 190/109; 190/115

[58] Field of Search ..... 190/103, 104, 190/18 A, 39, 115, 109; 206/279, 287, 287.1, 527, 278

[56] References Cited

U.S. PATENT DOCUMENTS

| | | | |
|---|---|---|---|
| D. 177,591 | 5/1956 | Robinson | D3/278 X |
| D. 179,619 | 2/1957 | Barber | D3/278 |
| 1,914,087 | 6/1933 | Gilmore | 190/107 X |
| 1,975,294 | 10/1934 | Sand et al. | 190/107 X |
| 2,062,462 | 12/1936 | Levine | 206/292 |
| 2,154,630 | 4/1939 | Marbury et al. | 190/111 |
| 2,533,333 | 12/1950 | Kitson | 190/107 X |
| 2,554,668 | 5/1951 | Plath | 206/289 |
| 3,777,862 | 12/1973 | Zipper | 190/107 |
| 3,933,229 | 1/1976 | Pelavin | 190/111 X |
| 4,206,835 | 6/1980 | Shapiro | 190/108 |
| 4,363,388 | 12/1982 | London et al. | 206/287 X |
| 4,618,035 | 10/1986 | Mao | 206/287.1 X |
| 4,655,343 | 4/1987 | Lane et al. | 206/287.1 |
| 4,693,368 | 9/1987 | King et al. | 206/287.1 |
| 4,736,839 | 4/1988 | King | 206/287.1 |
| 4,854,431 | 8/1989 | Pulichino, Jr. et al. | 190/108 |
| 4,863,018 | 9/1989 | King et al. | 206/290 |
| 4,925,021 | 5/1990 | Pulichino, Jr. | 206/279 |
| 4,927,014 | 5/1990 | Pulichino, Jr. | 206/287.1 |
| 4,995,487 | 2/1991 | Plath | 190/111 X |
| 4,998,603 | 3/1991 | Nordstrom | 190/18 A |
| 5,054,589 | 10/1991 | Bomes et al. | 190/18 A |
| 5,105,920 | 4/1992 | Grebenstein | 190/903 X |
| 5,109,961 | 5/1992 | Bergman | 190/18 A |
| 5,113,982 | 5/1992 | Pulichino et al. | 190/18 A |
| 5,375,685 | 12/1994 | Plath | 206/287.1 X |

FOREIGN PATENT DOCUMENTS

| | | | |
|---|---|---|---|
| 135835 | 12/1933 | Austria | 206/289 |
| 5130910 | 5/1993 | Japan | 206/287.1 |

*Primary Examiner*—Sue A. Weaver
*Attorney, Agent, or Firm*—Hill, Steadman & Simpson

[57] ABSTRACT

A luggage piece and a method for packing and transporting the same are provided. A first compartment has an interior for carrying first items. A second compartment is provided for carrying second items. The second items are distinguishable from the first items in that the second compartment includes a hanging device for hanging articles from the hanging device. The second compartment, therefore, acts as a garment carrier and the first compartment acts as a standard luggage compartment. The first compartment and the second compartment are integrally formed as a single luggage piece for simple packing and unpacking of articles as well as simplified transport of the luggage piece following packing of the articles. An extendable arm having a handle and wheels is provided for transport of the luggage piece.

19 Claims, 3 Drawing Sheets

GARMENT CARRIER WITHIN SUITCASE AND METHOD FOR PACKING

This is a continuation of application Ser. No. 08/137,610, filed Oct. 14, 1993, now abandoned.

BACKGROUND OF THE INVENTION

The present invention generally relates to a suitcase or a luggage piece. More specifically, the invention relates to a suitcase or a luggage piece having a garment carrier integrally incorporated therein.

Of course, various types of luggage and suitcases are generally known and available. A standard piece of luggage typically has at least one compartment for holding articles, such as clothing, as required for a traveller. Access may be provided to an interior of the compartment by a fastener, such as a zipper, which selectively opens and closes the compartment for access thereto.

Another known type of luggage piece is a garment bag. Garment bags are typically provided for carrying, for example, suits, dresses and other like articles in which wrinkling of the articles is a concern and is attempted to be minimized. To this end, known garment bags have a fastener, such as a zipper, running the length of the bag providing access to an interior of the bag. Garments can generally be placed directly on their respective hangers onto a hook within the interior of the garment bag. The garment bag may then be fastened in a closed position. Such garment bags generally include a single fold for dividing the length of the garment bag in half for simplified carrying, such as "over-the-shoulder", and storage thereof.

Numerous attempts have been made to combine a garment bag and a luggage piece as a single unit. Examples of such bags are disclosed in U.S. Pat. Nos. 4,206,835; 4,693,368; 4,854,831; 4,863,018; 4,925,021; 4,998,603; 5,054,589; and 5,113,982. Each of these carriers which combine a garment bag and suitcase or other luggage piece is cumbersome or difficult to manipulate for adding articles to the luggage compartment and/or the garment carrying compartment, removing articles from the luggage compartment and/or the garment carrying compartment, and/or carrying or otherwise transporting the combined garment carrying bag and luggage piece during travel.

U.S. Pat. No. 4,206,835 to Shapiro relates to a flexible garment bag and carrying case constructed to enable their separable connection to one another so that the assembly may be carried as a compact unit. The garment bag comprises first and second handles of flexible material connected to one another at their edges. The carrying case has a length substantially equal to the width of the garment bag, and the garment bag has a length sufficient to substantially cover the bottom wall and the side walls of the carrying case in the assembled relationship of the garment bag and carrying case. Connectors are secured to the carrying case, and longitudinally spaced connector means are secured to the second panel to extend from each end of the garment bag for separable connection to the connectors secured to the carrying case.

U.S. Pat. No. 4,693,368 to King et al. relates to an article of luggage including a garment bag enclosure and a packing case enclosure cooperating with one another when in use. The packing case enclosure is connected to an inner panel of the garment bag enclosure. During transport, the-garment bag enclosure folds over the top of the packing case enclosure, and the luggage article is transported by carrying devices attached preferably to the exterior panel of the garment bag enclosure. During use, the interior panel of the garment bag enclosure is disconnected, and the packing case enclosure moves or pivots outwardly to an extended orientation. A divider panel provides access to the interior of the packing case enclosure while access to the garment bag enclosure is simultaneously available as a result of detachment of the interior panel. The luggage article can be used to house garments on hangers and other small items within the packing case thereby avoiding the requirement for unpacking and repacking the luggage article.

U.S. Pat. No. 4,854,431 to Pulichino, Jr. et al. relates to a suitcase having two compartments. A garment bag is twice folded upon itself and packed in one of the compartments. The front panel of the suitcase when opened permits removal of the garment bag in its entirety from the suitcase for hanging directly over a bar in a closet or the like.

U.S. Pat. No. 4,863,018 to King et al. relates to a luggage case having devices for holding garments on hangers. A buckle and strap arrangement holds hook portions of a number of closet type hangers snugly and compactly near a wall of the luggage case. A packing bar comprises a laterally extending rod held by flexible rod supports. The rod supports-are detachably and pivotably mounted to opposite side walls of the case and have a length which permits adjustable positioning of the rod relative to the bottom wall of the case depending on the number and thickness of the clothes being packed.

U.S. Pat. No. 4,925,021 to Pulichino, Jr. relates to a soft luggage-type suitcase having three compartments enclosed by panels or lids hinged to a container having top, bottom and side walls. One of the compartments is closed by a lid having a wide rim at its free end and a narrow rim forming a hinge of the lid to the container. A diagonal rim connects the narrow rim to the wide rim. A universal hanger is connected to the wide rim, and an extender panel is hinged to the top wall of the container and cooperates with the lid and universal hanger for packing long garments.

U.S. Pat. No. 4,998,603 to Nordstrom relates to an article of luggage including a garment bag portion and a valet case selectively removable from the garment bag portion or which can be stored within the interior of the garment bag portion. The valet case is deployable to a supported position adjacent the garment bag portion for use.

U.S. Pat. No. 5,054,589 to Bomes et al. relates to a luggage case having a luggage frame which is substantially continuous and centrally located to support the top, bottom and end walls of the luggage. Two flexible side walls are provided with a zipper opening and closing the end, and a flexible center partition is removable and adapted to provide either two separate, individually accessible compartments for the luggage case or a single compartment accessible through one of the side wall openings. Hanging devices are included within the interior of the luggage case for holding a hanging article with straps which secure the end of the article opposite the hanger within an interior side wall to provide a garment-type bag.

U.S. Pat. No. 5,113,982 to Pulichino et al. relates to a garment bag including inner and outer panels and a pair of sides and ends joined together and joined to the outer panel defining an interior packing space. The inner and outer panels are foldable along a central axis such that the bag can be moved from a folded position and an unfolded position providing access to the inner packing space. The inner panel is divided into two separate sections which may be zipped and unzipped independent of the other to provide access to the inner packing space.

In view of the foregoing, a need exists for an improved suitcase incorporating an integral garment carrier that is simple to pack, simple to unpack and easily maneuverable during transport.

SUMMARY OF THE INVENTION

The present invention provides a luggage piece for carrying a first plurality of articles and a second plurality of articles, the first plurality of articles are contained within a luggage compartment and the second plurality of articles are contained within a garment carrying compartment. The first compartment and the second compartment are integrally formed at a junction wherein articles are suspended from a hanging device within an interior of the second compartment at the junction.

To this end, in an embodiment, the present invention provides an apparatus for carrying a first plurality of articles and a second plurality of articles. The apparatus comprises a first compartment defining an interior for holding the first plurality of articles, the first compartment having a side wall providing access to the interior of the first compartment. A second compartment defines an interior for holding the second plurality of articles wherein the side wall of the first compartment defines at least a portion of the interior of the second compartment. A fold-out wall defines a remainder of the interior of the second compartment. The fold-out wall has at least one fold wherein one fold is substantially at one end of the side wall of the first compartment. A hanging member opposite the one fold at one end of the sidewall suspends the second plurality of articles therefrom wherein the hanging member is within the interior of the second compartment.

In an embodiment, the hanging member includes a plurality of grooved portions.

In an embodiment, the interior of the second compartment includes straps for securing the second plurality of articles within the interior of the second compartment.

In an embodiment, an exterior of the second compartment is securable by straps to the side wall.

In an embodiment, an extendable handle extends from an exterior portion of the first compartment.

In an embodiment, a plurality of wheels are provided at the base of the first compartment.

In an embodiment, a fastening means provides access to the interior of the second compartment.

In an embodiment, the hanging member is at least partially pivotable.

In an embodiment, a plurality of handles are provided for carrying the first compartment and the second compartment in a corresponding plurality of orientations.

In another embodiment of the present invention, a combination suitcase and garment carrier is provided. A first compartment carries a plurality of articles. A second compartment carries a plurality of hanging articles. The second compartment is integrally formed with the first compartment at a junction and extendable at at least one fold, a first fold opposite the junction. A hanging member within an interior of the second compartment is provided wherein the hanging member is secured substantially at the junction for suspending the plurality of hanging articles therefrom in the second compartment.

In an embodiment, an extendable arm is provided having a handle for simultaneously pulling the first compartment and the second compartment.

In an embodiment, a first plurality of flexible straps within an interior of the second compartment maintains the plurality of hanging articles, and a second plurality of straps about an exterior of the second compartment secures the second compartment after folding the second compartment at the fold.

In an embodiment, at least one side pocket is provided exterior from both the first compartment and the second compartment.

In an embodiment, a fastener extends along a length of the second compartment providing selective access to the interior.

In another embodiment of the present invention, a method is provided for packing and carrying a first plurality of articles and a second plurality of articles wherein the second plurality of articles are individually placed on hanging members. The method comprises the steps of: providing a first compartment having an interior for receiving the first plurality of articles; providing a second compartment having a hanging device and further having an interior for receiving the second plurality of articles; suspending the hanging members from the hanging device in the second compartment; folding, at least once, the second compartment; and inverting the second compartment into a portion of the first compartment.

In an embodiment, the method further comprises the step of securing the interior of the second compartment prior to folding the second compartment.

In an embodiment, the method further comprises the step of securing the second compartment prior to inverting the second compartment.

It is, therefore, an advantage of the present invention to provide a luggage piece for carrying both a first plurality of articles and a second plurality of articles wherein at least the second plurality of articles are hanging-type articles.

Further, an advantage of the present invention is to provide a luggage piece which is constructed and arranged for simple packing.

A further advantage of the present invention is to provide a luggage piece which is constructed and arranged for simple unpacking.

Yet another advantage of the present invention is to provide a luggage piece which is simple to maneuver or transport when packed.

A still further advantage of the present invention is to provide a luggage piece that is integrally formed as one piece.

Moreover, an advantage of the present invention is to provide a luggage piece that is durable.

Still further, an advantage of the present invention is to provide a luggage piece which is compact yet holds a variety of distinct items.

And, another advantage of the present invention is to provide a luggage piece that can be carried in a plurality of orientations or carried in a plurality of modes.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a luggage piece having a garment carrier incorporated therein. Further, the present invention discloses a luggage piece having a side flap which opens to expose a garment carrier incorporated in the side wall of the luggage piece. The garment carrier itself includes a flap extending longitudinally outward from the interior compartment of the luggage piece for insertion of garments therein. The garment carrier may be folded once and secured to the side flap. The side flap of the luggage piece may then be secured thereby enclosing the garment carrier and its contents within the interior of the luggage piece.

Figure 1:
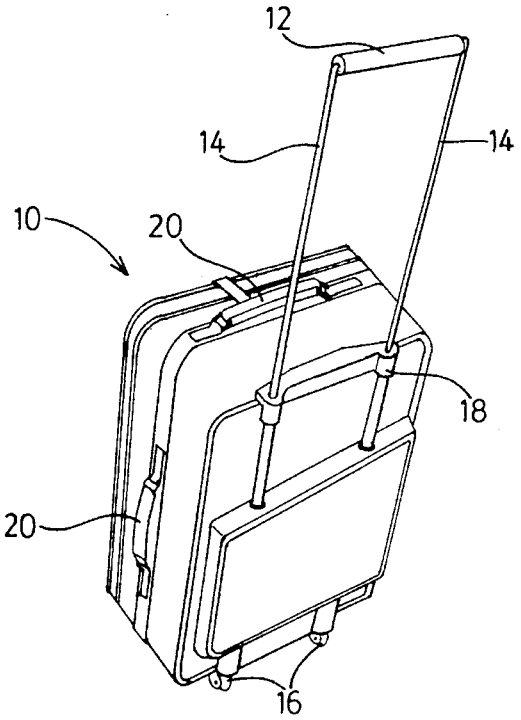
FIG. 1 illustrates a perspective view of an integral garment carrier incorporated within a luggage piece of the present invention.

Referring now to the drawings wherein like numerals refer to like parts, FIG. 1 generally illustrates a luggage piece 10. A handle 12 is integrally connected to a pair of telescoping rods 14. The rods 14 extend and affix in the position shown in FIG. 1 for generally simplified transport or maneuvering of the luggage piece 10 by an individual pulling the luggage piece 10 by the handle 12.

Wheels 16 are provided at the base of the luggage piece 10. The telescoping rods 14, of course, can be released from the position shown in FIG. 1 such that the handle 12 rests against a surface 18. The luggage piece 10 alternatively can be carried by one or more handles 20 secured to an exterior periphery of the luggage piece 10.

Figure 2:
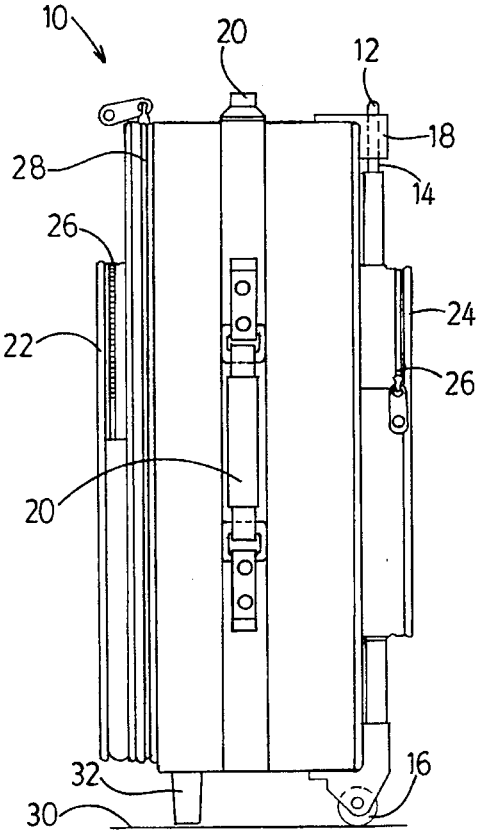
FIG. 2 illustrates a side elevational view of the luggage piece with the incorporated integral garment carrier of the present invention.

Referring now to FIG. 2, the luggage piece 10 is illustrated having two side compartments 22, 24. Each side compartment 22, 24 forms an interior compartment enclosed by a fastening device, such as a zipper 26. Of course, other fastening means, such as snaps, buckles, Velcro, and the like, can be implemented for securing and enclosing the side compartments 22, 24.

For access to the main interior compartment of the luggage piece 10, another fastening member is provided, such as the zipper 28. Again, other fastening means may be provided for providing access to as well as enclosing the luggage piece 10. The luggage piece 10, as illustrated, is standing on a surface 30. The luggage piece 10 is maintained substantially level with the wheels 16 and a pair of feet 32, one of which is shown in FIG. 2.

Figure 3:
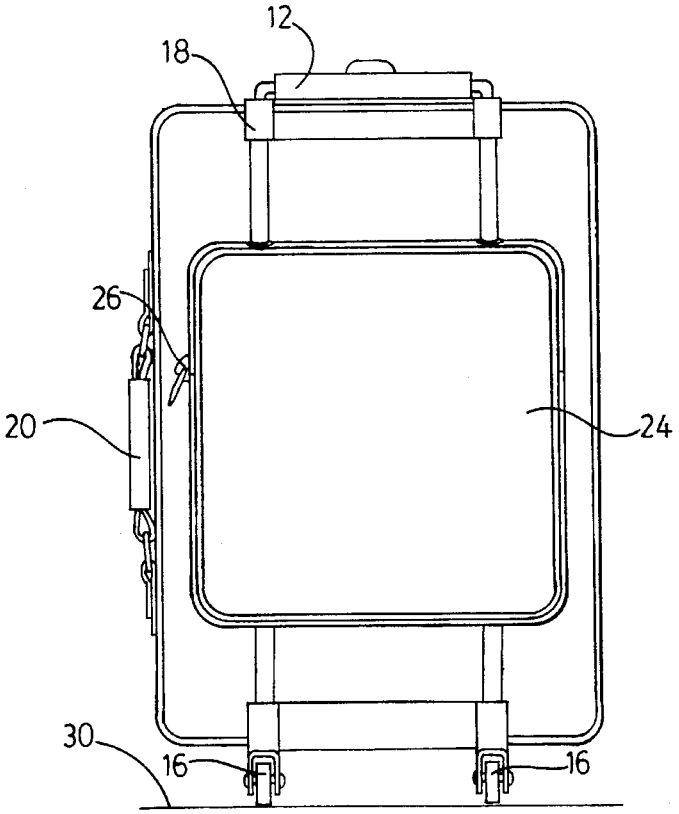
FIG. 3 illustrates a rear elevational view of the luggage piece with the incorporated integral garment carrier of the present invention.

Referring now to FIG. 3, the handle 12 is illustrated in its stowed position against the surface 18. In this position, the luggage piece 10 can be carried by an individual by gripping one of the handles 20.

Figure 4:
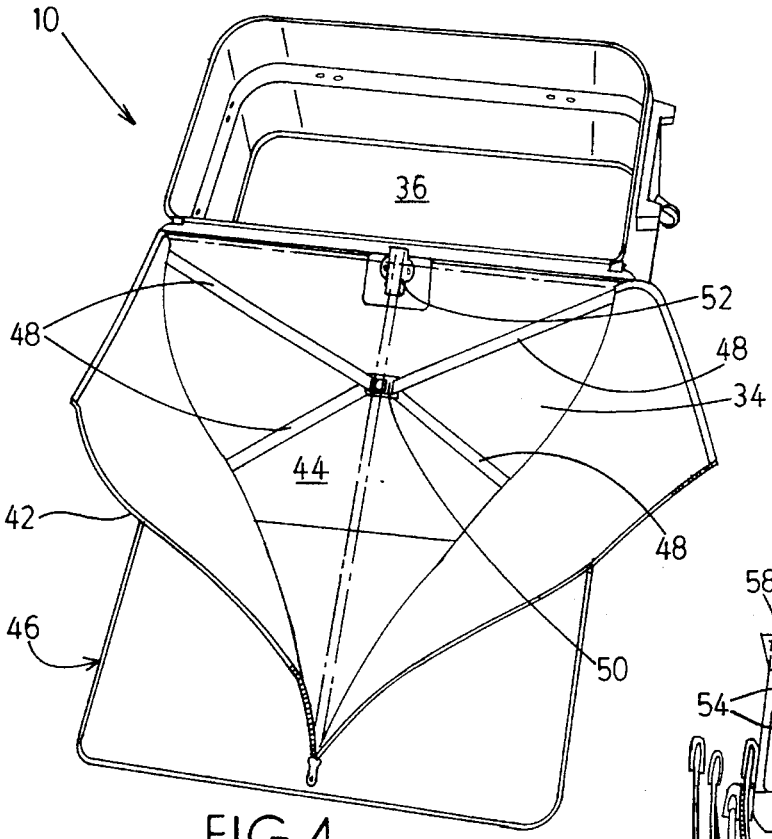
FIG. 4 illustrates a perspective view of the luggage piece of the present invention in its unfastened position with the garment carrier unfastened for insertion of garments into the carrier.
Figure 5:
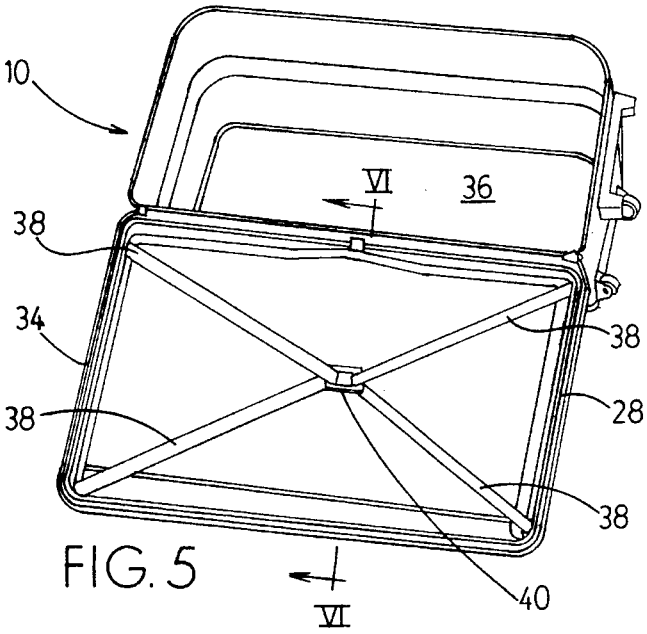
FIG. 5 illustrates a perspective view of the garment carrier secured prior to closing the fastener enclosing the interior of the luggage piece and garment carrier of the present invention.

As shown in FIGS. 4 and 5, the luggage piece 10 can be open to the position illustrated in FIG. 5. In this position, a side wall 34 previously secured by the zipper 28 is inverted to expose and provide access to an interior 36 of the luggage piece 10. A pair of flexible diagonal straps 38 meet at a fastener 40, such as a buckle. Of course, other known fasteners may be implemented to maintain the interior portion of the side wall 34 in the position illustrated in FIG. 5.

Upon release of the fastener 40 thereby releasing the flexible straps 38, a garment bag portion generally illustrated at 46 of the luggage piece 10 may be accessed as shown in FIG. 4. To this end, a longitudinal fastener, such as a zipper 42, is provided. The zipper 42 in the position shown in FIG. 4 provides access to an interior 44 of the garment bag portion 46.

Additional flexible straps 48 are provided in the interior of the garment bag portion 46 and, again, meet at a fastener 50, such as a buckle. The flexible straps 48 are released at the fastener 50 prior to adding garments to the interior 44 of the garment bag portion 46. Once garments have been added thereto, the flexible straps 48 are secured at the fastener 50 to maintain the garments within the interior 44 of the garment bag portion 46.

A hanging device generally illustrated at 52 is provided in the interior 44 of the garment bag portion 46 preferably at a juncture between the interior 36 of the luggage piece 10 and the side wall 34. Of course, the hanging device 52 may be positioned elsewhere within the interior of the garment bag portion 46 as desired. However, the preferred arrangement of the hanging device 52 illustrated in FIG. 4 provides convenient loading and unloading of garments into the garment bag portion 46 without removal of the entire garment bag portion 46 from the luggage piece 10. Further, the preferred arrangement of the hanging device 52 provides simple loading of the luggage piece 10 following insertion of garments into the garment bag portion 46.

To this end, garments are first placed, preferably on conventional-type hangers or the like, onto the hanging device 52. The hanging device 52 is, preferably, a latch-type mechanism wherein hangers may be placed on grooves 54 to maintain the hangers in a fixed position on the hanging device 52. As illustrated, four grooves 54 are provided on the hanging device 52 to secure one or more hangers in each of the grooves 54.

Figure 6:
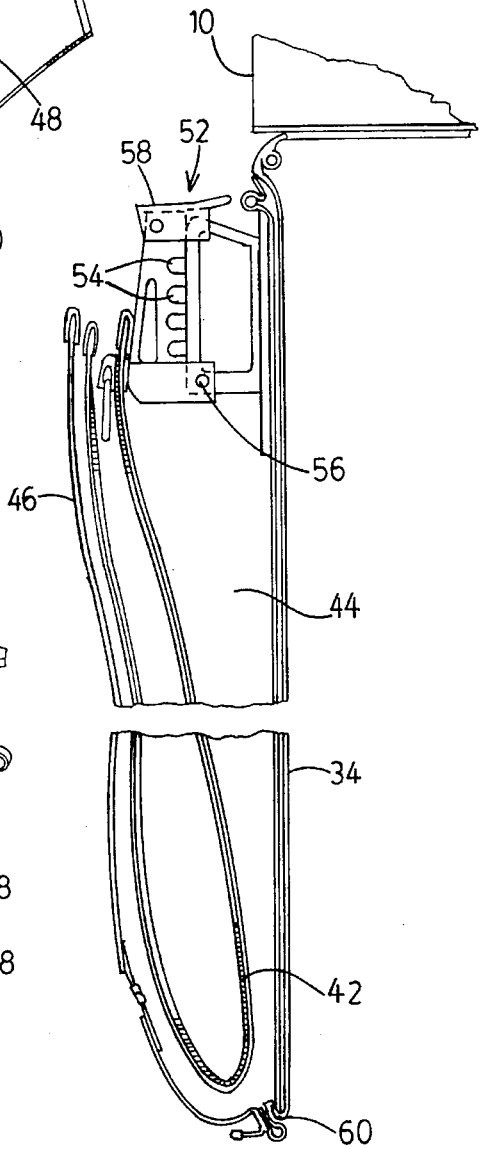
FIG. 6 illustrates a cross-sectional view of the garment carrier taken generally along the line VI—VI of FIG. 5.

The hanging device 52 as illustrated in FIG. 6 is in a latched position wherein the grooves 54 are vertically displaced. The hanging device 52 is partially rotatable about a pivot 56 by unlatching of the hanging device 52 at a pivoted latch 58. In the unlatched position, the grooves 54 are horizontally displaced from one another, and the hangers can then be simply suspended over each of the grooves 54.

Figure 7:
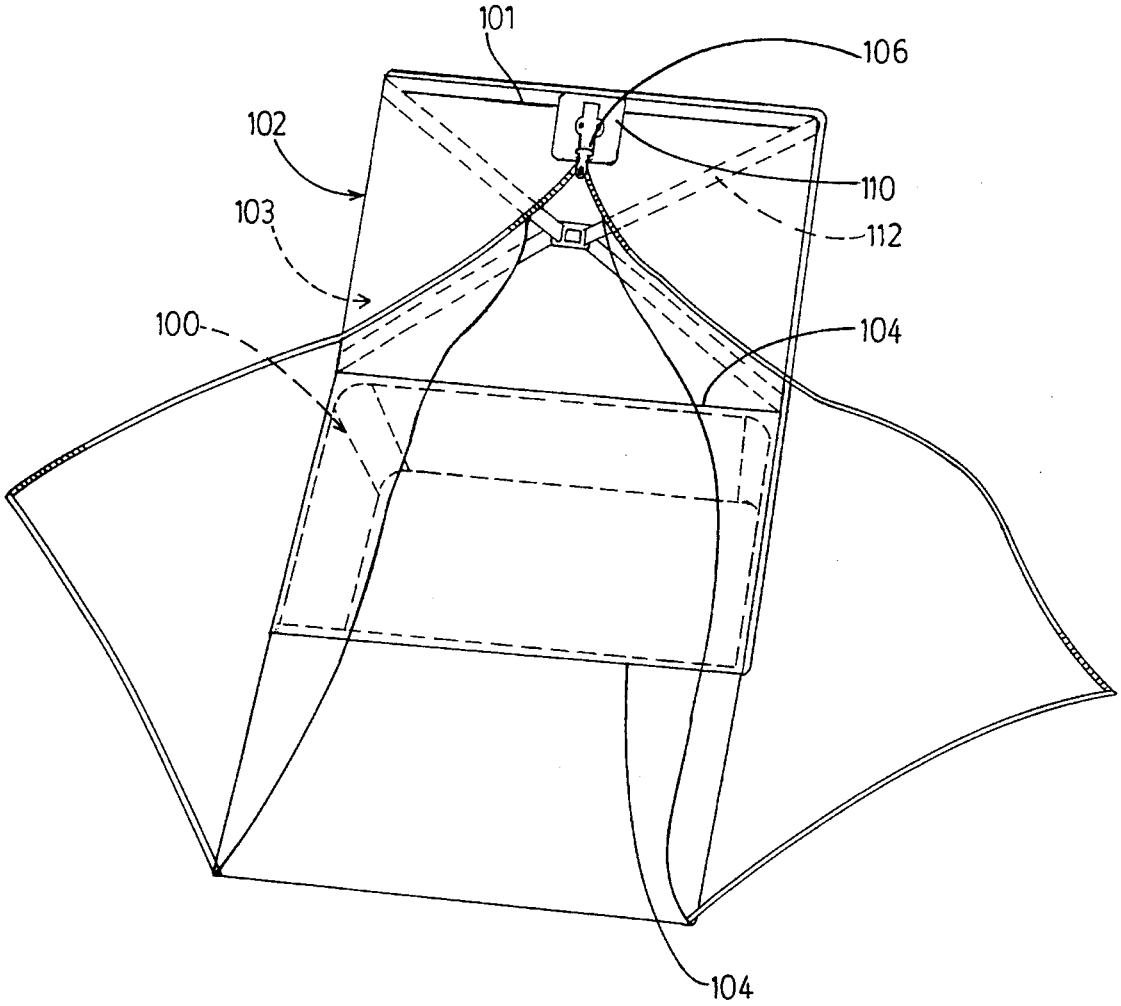
FIG. 7 illustrates a perspective view of another embodiment of the present invention illustrating a two-fold garment carrier integral with a luggage piece.

FIG. 6 illustrates the garment bag portion 46 without any garments secured to the hanging device within the interior 44 of the garment bag portion 46. In this position, the side wall 34 may be suspended from the luggage piece 10. The garment bag portion 46 may be accessed by unfastening the zipper 42 opposite the position shown in FIG. 6. Garments may be placed into the interior 44 of the garment bag portion 46 and the zipper 42 may be refastened as shown. Some garments, of course, may require folding upon the garment itself to fit within the interior of the single fold garment bag portion 46. Further, the zipper 42 may be secured to the garment bag portion 46 so as to run in a direction opposite that shown. This zipper arrangement is illustrated in FIG. 7 and will be described hereinafter. After folding the garment bag portion 46, the side wall 34 may then be inverted to enclose the interior 36 of the luggage piece 10. The garment bag portion 46 is folded within the boundaries of the side wall 34 between the juncture and the end point 60.

Referring now to FIG. 7, another embodiment of the present invention is illustrated. A luggage piece 100 is shown in phantom having a two-fold garment bag portion 102. The garment bag portion 102 includes two folds generally illustrated at 104. The garment bag portion 102 further includes a zipper 106 which, in the open position illustrated, starts at an end of a side wall 101 of the luggage piece 100, but from the inside of the luggage piece 100. A hanging device 110 is provided and secured at the end of the side wall 100 at which the zipper 106 starts in the open position. The hanging device 110 is identical to that previously described. Flexible straps 112 are further provided as also previously described with reference to FIGS. 1–6.

The two fold garment bag portion 102 allows longer garments to be placed within its interior 103 without folding of the garments as may be required for the single fold garment bag portion 46 illustrated in FIG. 4. The flexible straps 112 can be located elsewhere within the interior 103 of the garment bag portion 102 as desired for securing garments within its interior 103.

As will be appreciated, the hanging device within the interior of the garment bag portion may be positioned at either end of the garment bag portion. Further, the zipper or other fastener enclosing the garment bag portion may run in either direction across the length of the garment bag portion. Of course, the zipper or other like fastener may partially extend across the length or may be provided in another orientation, such as diagonally, for example.

The exterior of the luggage piece 10 or the luggage piece 100 can be constructed from a heavy, durable canvas-type cloth or any other durable material resistant to typical wear or abuses during travel and transport of the luggage piece 10, 100. The interior of the garment bag portion 46 or 102 is generally constructed of a lighter-weight, but durable, material. The lighter material provides ease in folding the same. Further, less interior space is required for the garment bag portion 46, 102 when folded into the luggage piece 10, 100, respectively.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for carrying a first plurality of articles and a second plurality of articles, the apparatus comprising:

a first compartment defining an interior capable of holding the first plurality of articles, the first compartment having a sidewall, the sidewall having a first side facing the interior of the first compartment when the sidewall is enclosed by a fastener, the fastener defining a periphery of the sidewall except for one side wherein the sidewall provides selective access to the interior of the first compartment;

a second compartment defining an interior capable of holding the second plurality of articles wherein the first side of the sidewall of the first compartment defines at least a portion of the interior of the second compartment and further wherein a remainder of the interior of the second compartment is defined by a fold-out portion wherein the fold-out portion extends beyond the periphery of the sidewall from the first side and has a length extending from the first side of the sidewall of the first compartment wherein the length is defined between a first end at the one side of the sidewall and an opposite end beyond the periphery of the sidewall and further wherein the fold-out portion includes a fastening means to selectively access the interior of the second compartment wherein the fastening means extends substantially the length of the fold-out portion; and a hanging member constructed and arranged at one of the ends of the length of the fold-out portion for suspending the second plurality of articles therefrom, the hanging member being within the interior of the second compartment.

2. The apparatus of claim 1 wherein the hanging member includes a plurality of grooved portions.

3. The apparatus of claim 1 wherein the interior of the second compartment includes straps for securing the second plurality of articles within the interior of the second compartment.

4. The apparatus of claim 1 wherein the fold-out portion is securable by straps to the sidewall.

5. The apparatus of claim 1 further comprising:

an extendable handle extending from an exterior portion of the first compartment.

6. The apparatus of claim 1 further comprising:

a plurality of wheels attached to the first compartment.

7. The apparatus of claim 1 wherein the hanging member is at least partially pivotable at a pivot point of the hanging member.

8. The apparatus of claim 1 further comprising:

a plurality of handles for carrying the first compartment and the second compartment wherein one of the plurality of handles is constructed and arranged on a first exterior sidewall of the first compartment and another one of the plurality of handles is constructed and arranged on a second exterior sidewall of the first compartment.

9. A combination of a suitcase and a garment carrier, the combination comprising:

a first compartment having an interior capable of carrying a plurality of articles wherein the first compartment has a sidewall providing access to the interior of the compartment wherein the sidewall has a first side facing the interior of the first compartment and further wherein the sidewall has a fastener selectively securable and defining a periphery of the sidewall except for one side thereof;

a second compartment having an interior capable of carrying a plurality of hanging articles, the second compartment integrally formed with the first compartment at the one side wherein a length of the second compartment is sufficient to extend the length of the second compartment outside the periphery of the sidewall from the first side; and a hanging member within an interior of the second compartment wherein the hanging member is secured substantially at the one side of the sidewall and on the first side of the sidewall and suspends the plurality of hanging articles therefrom in the interior of the second compartment.

10. The combination of claim 9 further comprising:

an extendable arm having a handle for simultaneously pulling the first compartment and the second compartment.

11. The combination of claim 9 further comprising:

a first plurality of flexible straps within an interior of the second compartment maintaining the plurality of hanging articles; and a second plurality of straps about an exterior of the second compartment securing the second compartment after folding the second compartment at the fold.

12. The combination of claim 9 further comprising:

at least one side pocket exterior from both the first compartment and the second compartment.

13. The combination of claim 9 further comprising:

a fastener extendable along a length of the second compartment providing selective access to the interior.

14. The combination of claim 9 wherein the hanging member is pivotably secured at a pivot point and further includes a plurality of grooves.

15. A method for packing and carrying a first plurality of articles and a second plurality of articles wherein the second plurality of articles are individually placed on hanging members, the method comprising the steps of:

providing a first compartment having an interior capable of receiving the first plurality of articles wherein the first compartment has a sidewall selectively accessible by a fastener to access the interior of the first compartment;

providing a second compartment having a hanging device and further having walls on the sidewall in the interior of the first compartment, the walls defining an interior of the second compartment wherein the interior of the second compartment is selectively accessible by a fastener, and further wherein the interior of the second compartment is capable of receiving the second plurality of articles only when the interior of the first compartment is accessible and further wherein at least a portion of the interior of the second compartment is defined by the sidewall of the first compartment and a remainder of the second compartment is defined by the walls of the second compartment wherein the walls extend beyond a periphery of the sidewall of the first compartment;

suspending the hanging members from the hanging device in the interior of the second compartment;

folding, at least once, the walls of the second compartment forming the sidewall of the first compartment; and inverting the second compartment into the interior of the first compartment.

16. The method of claim 15 further comprising the steps of:

providing straps in the interior of the second compartment; and securing the second plurality of articles on the hanging device in the interior of the second compartment with the straps prior to folding the second compartment.

17. The method of claim 15 further comprising the steps of:

providing straps secured to the sidewall and exterior to the interior of the second compartment; and securing the second compartment to the sidewall of the first compartment with the straps prior to inverting the second compartment into the first compartment.

18. The method of claim 15 further comprising the step of:

providing an extendable arm constructed and arranged to assist in transporting the compartments,

19. The method of claim 15 further comprising the step of:

providing at least one wheel constructed and arranged to assist in transporting the compartments.

* * * * *